US005931104A

United States Patent [19]

Horn et al.

[11] Patent Number: 5,931,104

[45] Date of Patent: Aug. 3, 1999

[54] PIVOTAL HINGE SECURITY SAFE

[76] Inventors: William A. Horn, 2270 Wandering Ridge, Chino Hills, Calif. 91709; Steven J. Baker, 14080 Scenic View Rd., Lake Mathews, Calif. 92570

[21] Appl. No.: 09/103,144

[22] Filed: Jun. 22, 1998

[51] Int. Cl.[6] ..... E05G 1/04

[52] U.S. Cl. ..... 109/59 R; 109/74

[58] Field of Search ..... 109/59 R, 64, 109/73–75, 77; 16/250, 251, 392; 49/398

[56] References Cited

U.S. PATENT DOCUMENTS

| | | | |
|---|---|---|---|
| 393,289 | 11/1888 | Becht | 109/74 |
| 406,848 | 7/1889 | Mosler et al. . | |
| 3,082,474 | 3/1963 | Anderson | 16/392 X |
| 3,808,984 | 5/1974 | Teleky | 109/59 R |
| 3,842,761 | 10/1974 | Bloom | 109/59 R |
| 4,598,647 | 7/1986 | Biedess | 109/74 X |
| 4,704,766 | 11/1987 | Almestad | 16/392 X |
| 4,704,970 | 11/1987 | Sanderson et al. . | |
| 4,878,267 | 11/1989 | Roach et al. . | |
| 5,209,168 | 5/1993 | Chapron et al. | 292/36 X |
| 5,280,755 | 1/1994 | Batur et al. | 109/74 X |
| 5,341,752 | 8/1994 | Hambleton | 109/59 R |
| 5,490,306 | 2/1996 | Floyd et al. . | |
| 5,544,595 | 8/1996 | Stephenson, III et al. . | |
| 5,666,695 | 9/1997 | Jegers et al. . | |

FOREIGN PATENT DOCUMENTS

| | | | |
|---|---|---|---|
| 4430 | 1/1892 | Germany | 109/74 |
| 39331 | 11/1936 | Netherlands | 109/74 |

*Primary Examiner*—Suzanne Dino Barrett
*Attorney, Agent, or Firm*—Gordon K. Anderson

[57] ABSTRACT

A pivotal hinge for a security safe that includes a cabinet (20) with a door opening (48) in the front having recessed doorjambs (30) and (46). The cabinet is smooth and devoid of any through-holes or hardware for attachment purposes. A door (50) is positioned within the opening and includes a pair of pivot pins (68) protruding from the top and bottom interfacing with a hole (40) in the top and a hollow compression sleeve (44) on the bottom. The door pivots on the pins and interfaces with the doorjambs on the door locking side (54), top (36) and bottom (38), while the hinge side (52) mates with a reversed discrete doorjamb (46), placing the door hinge side inside of the cabinet structure for protection. The pivot pin on the bottom is hid within the compression sleeve and the top pin is located at a rear portion of the door, making it essentially inaccessible from the outside.

11 Claims, 4 Drawing Sheets

PIVOTAL HINGE SECURITY SAFE

TECHNICAL FIELD

The present invention relates to hinges for safes in general, and more particularly to a security safe having a pair of pivot hinge pins that are inset into the top and bottom of a safe door with the door interfacing with integral doorjambs on three sides and inside of the safe cabinet on the hinged side.

BACKGROUND ART

Previously, many methods of hinging have been used with security safes in endeavoring to provide cost effective and secure protection from forcible entry. Some prior art has utilized an offset continuous hinge attached to a full width door within the gap on the side of the safe, others have used single hinge leaves, with the mating leaf formed integrally with the safe wall structure. An attempt to hide and protect the hinge was developed that included an extended narrow leaf attached to the door and a welded bracket and pin on the inside of the front wall. Labor and material savings and simplified rod-like pins for pivoting doors have been mainly ignored by prior art in the field of security safes.

A search of the prior art did not disclose any patents that read directly on the claims of the instant invention, however the following U.S. patents are considered related:

| U.S. Pat. No. | Inventor | Issue Date |
|---|---|---|
| 5,666,695 | Jegers et al | Sep. 16, 1997 |
| 5,544,595 | Stephenson, III et al | Aug. 13, 1996 |
| 5,490,306 | Floyd et al | Feb. 13, 1996 |
| 4,878,267 | Roach et al | Nov. 7, 1989 |
| 4,704,970 | Sanderson et al | Nov. 10, 1987 |
| 406,848 | Mosler et al | Jul. 9, 1889 |

Jegers et al in U.S. Pat. No. 5,666,695 teaches a leaf member having a pair of knuckles that include a retainer, which extends into the path of the pin. Annular grooves formed in the pin receive the retainer member and keep it from sliding in or out of the hinge. One of the grooves has a straight side and a tapered side allowing the pin to slide over the second groove but not the first. The structure of the safe corner is bent to form at least one knuckle and leaf member to mate with the second hinge leaf.

Pat. No. 5,544,595 issued to Stephenson, III et al discloses a hinge arrangement for a gaming device that includes a hinge connecting a door to a cabinet with a gap in-between when the door is closed. The hinge forms a pocket shaped barrier around the gap with an edge engaging a side of the pocket when pivoted 90 degrees, limiting its travel, precluding damaging adjacent gaming devices when the door is opened.

Floyd et al in their U.S. Pat. No. 5,490,306 is for a security cover for a barrel hinge having an inner cover plate.

Pat. No. 4,878,267 issued to Roach et al discloses a device for resisting entry of an object into a space between the hinged edge of a door and a jamb using a folded sheet of flexible material.

Sanderson et al, in Pat. No. 4,704,970, teaches a hinge assembly of a planar-surfaced mounting bracket and a J-shaped leaf member. A mounting bracket, in hex shape, is welded to the inner surface of the safe cabinet and the leaf member includes a pin that is retained by the bracket. The leaf member penetrates an open section of the frame and forms a door stop when contiguously abutting therebetween.

For background purposes and as indicative of the art to which the invention relates, reference may be made to the patent issued to Mosler et al.

DISCLOSURE OF THE INVENTION

The purpose of any type of security safe is to provide a mechanical device to retain valuable items protected from unauthorized entry, fire or acts of nature, such as a catastrophic disaster. A door or other entry means must be included in any safe, as access is always required by the individual protecting his or her valuables. Historically, locks of one type or the other have been used to secure this door and, therefore are well known to those skilled in the art. Particularly large and robust locks and boltwork have been utilized in safes for centuries to secure the door when it is closed. In security safes, particularly of the size and configuration to store firearms, such as rifles and shotguns, it has been found that spring-loaded detente boltwork with manual or electronic locks and spring-loaded relockers have been utilized for some time to assure the desired protection. This locking defense has developed over time into a fine art and much effort has been directed to its use as the primary security measure for protecting a safe door.

The door hinge has always been very vulnerable as it is necessary for functional operation and is, in some instances, actually exposed on the outside of the safe making it readily accessible. The basic hinge has seen little improvement over the years, as it is simple in its design, normally using a pin retained or enclosed on both a fixed side and a movable side. It is, therefore, a primary object of the invention to hide the bottom hinge and locate the top hinge in an area that is basically inaccessible from the outside, and therefore difficult to reach. This is accomplished by using a pair of hardened rod-like pins each connected permanently into the door on the top and bottom. The pins interface with a hole in the doorjamb on the top and a hollow sleeve welded permanently into the bottom of the safe cabinet. This arrangement places the bottom of the door directly on the sleeve with all of the door weight resting upon this intersection, hiding the pin entirely from view. The pin on the top of the door is slightly exposed, however it is located at the back of the door and the door is recessed from the front of the cabinet. Further, the location of the pin places the pivot point away from the door edge and three sides of the door interface with conventional doorjambs, however the hinge side of the door mates with a reversed or opposite doorjamb. As such, the door is held in place on three sides by a locking mechanism, while the hinge side is actually behind the front of the cabinet. This arrangement of simple pins in the door and mating holes in the cabinet creates an extremely difficult problem for a burglar or thief to attempt to breach the security of the safe by cutting or drilling away the hinge, as the pin is protected on the top by its inaccessibility and on the bottom by the use of a protective hollow sleeve. The material of the cabinet itself is sufficiently robust to deter cutting or being bent and, further, the pivot rod is actually embedded into the door inner panel and welded in place.

An important object of the invention is directed to the use of an extremely hard and tough structural material for the pivot pins. It has been found that cobalt steel alloy bar stock is best suited for the application, due to its extremely high strength and heat resistance. Its imperviousness to cutting with toothed blades is well known and its ultimate strength as an alloy steel makes an ideal composition for the hinge pin.

Another object of the invention is the unique construction of the door creating a cost effective fabrication method that is repeatable, accurate and does not require tooling in the form of jigs or fixtures to hold the pins securely for welding in place. This object is accomplished by punching a keyhole shaped slot in the inner door and manually positioning the pin in the slot and welding it in place on both the front and the back. The outer door contains a open ended slot that is also punched in the flat and when it is nested into the inner door overlaps the pin, further binding it in place.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
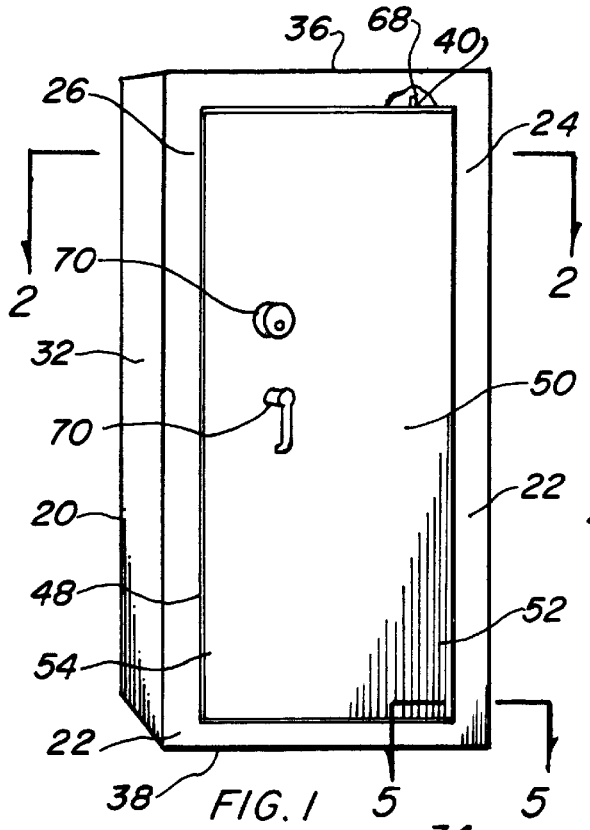
FIG. 1 is an isometric view of the preferred embodiment with the door closed.
Figure 5:
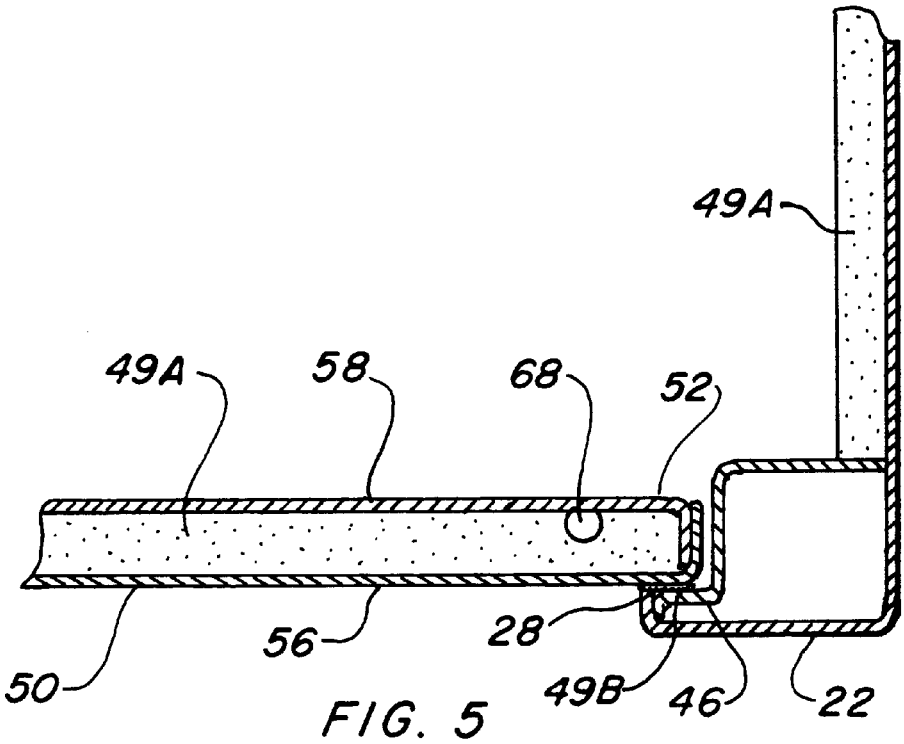
FIG. 5 is a cross-sectional view taken along lines 5—5 of FIG. 1 showing the bottom pin and safe corner arrangement with the door closed.
Figure 6:
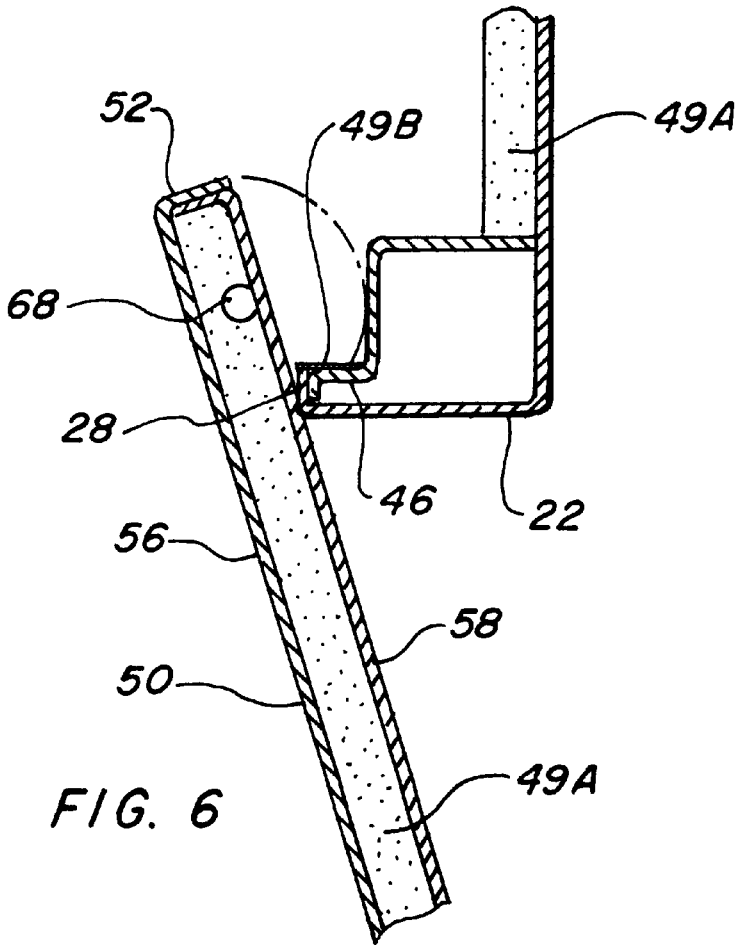
FIG. 6 is a cross-sectional view taken along lines 6—6 of FIG. 3 showing the bottom pin and safe corner arrangement with the door open.

The best mode for carrying out the invention is presented in terms of a preferred embodiment. The preferred embodiment, as shown in FIGS. 1 through 17 is comprised of a cabinet 20, illustrated in FIGS. 1 and 3, that includes a front 22 with a hinge edge 24 and a locking edge 26. The hinge edge 24 contains an inwardly protruding flange 28, as depicted best in FIGS. 5 and 6, and the front locking edge 26 includes a doorjamb 30. The cabinet 20, also has a pair of sides 32, a back 34, a top 36 and bottom 38. The top 36 and bottom 38, further contain an integrally formed doorjamb 30. The top doorjamb 30 has a pin receiving hole 40 adjacent to the cabinet front hinge edge 24. The bottom doorjamb 30 has a sleeve retaining hole 42, again adjacent to the cabinet front hinge edge 24 and in line with the pin retaining hole 40. A load bearing compression sleeve 44 is disposed within the retaining hole 42 by permanent joining means in the form of resistance welding. The sleeve 44 is best illustrated as installed in FIG. 15 and by itself in FIG. 17.

The cabinet front 22 and one side 32, on the locking edge 26, have a reversed discrete doorjamb 46 that is permanently attached to the inwardly protruding flange 28. This arrangement of elements is clearly depicted in FIGS. 5 and 6, and the discrete doorjamb 46 overlaps the cabinet hinge edge flange 28, forming a double thickness of material. It will be noted that this doorjamb 46 reinforces the locking edge 26 and creates a strong and durable corner cross-section. All four of the doorjambs 30 and 46 together form a door opening 48, although the hinge edge 24 is reversed.

The cabinet front 22, sides 32 and back 34 are formed from a single segment of flat metal sheetstock, such as carbon steel that has been pickled and oiled, of a thickness varying as to the size of the cabinet, with 10 gauge (0.1345 in. or 0.342 cm.) being preferred in most conventional configurations. The top 36 and bottom 38 are welded to the cabinet front, back and top, making an enclosure that contains no through holes for mounting hardware for attachment of any component parts. This permanent method of joining the cabinet 20 together forms a secure barrier preventing entry, as no joints are visible and no weak points exist in the design. The cabinet 20 may be unlined or contain a fireproof lining of non-flammable insulation 49A, along with a heat activated self-sealing gasket 49B attached around the door opening 48 onto the doorjambs 30 and 46. Optional interiors 49C, such as high density fiberboard with solid oak facing and a lint-free foam back material configured as shelves, rifle stalls, or a combination thereof, may also be utilized within the cabinet 20.

Figure 7:
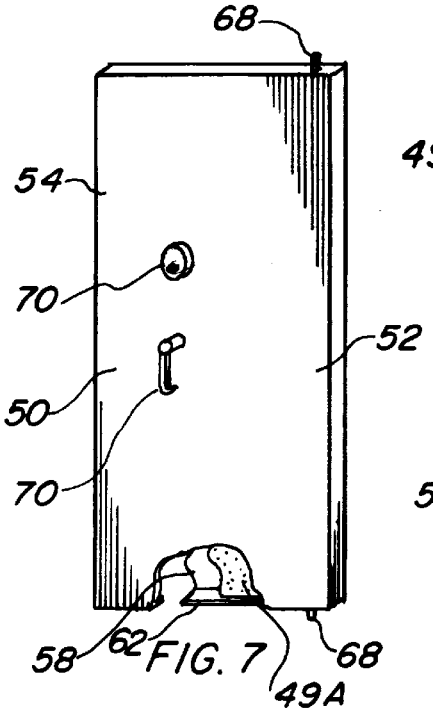
FIG. 7 is a partial isometric view of the front of the door completely removed from the invention for clarity and cut-away to illustrate the outer and inner panels.
Figure 8:
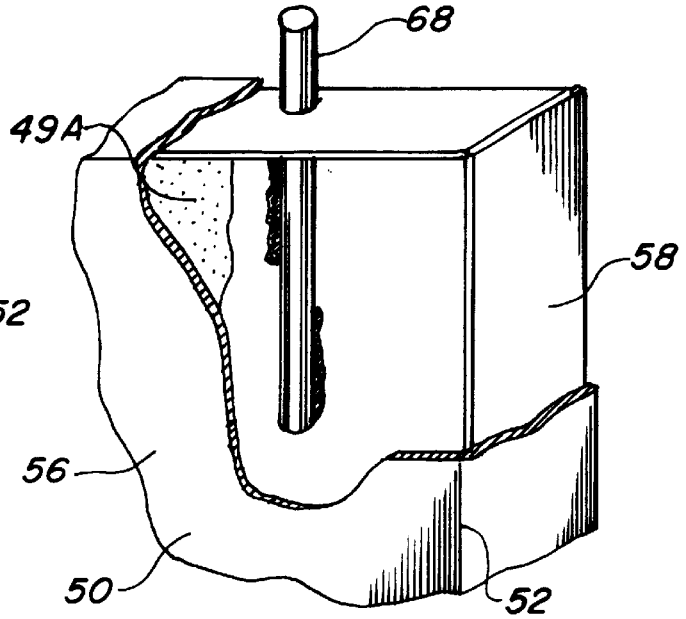
FIG. 8 is a partial isometric view of the front of the door completely removed from the invention for clarity and cut-away to show the pin attached inside.

A door 50 is positioned within the door opening 48 and is comprised of a hinge side 52 and a locking side 54 and consists collectively of an outer panel 56 juxtapositioned over an inner panel 58, as depicted in FIGS. 5 through 14, particularly FIGS. 7 and 8, where the door is cut-away to illustrate this panel relationship. The outer panel has inwardly protruding flanges 60 and the inner panel 58 has outwardly protruding flanges 62, such that all flanges contiguously embrace each other. The door 50 is actually formed from two separate segments of flat metal sheetstock with the above described bent flanges 60 and 62 on each panel 56 and 58, respectively. As the door 50 is completely flat and smooth, no through-holes or mounting hardware is present, making a secure barrier and, therefore, preventing entry into the safe.

Figure 9:
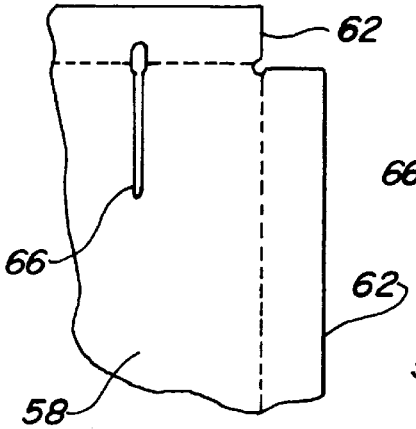
FIG. 9 is a front view of the corner of the door inner panel in the flat.
Figure 10:
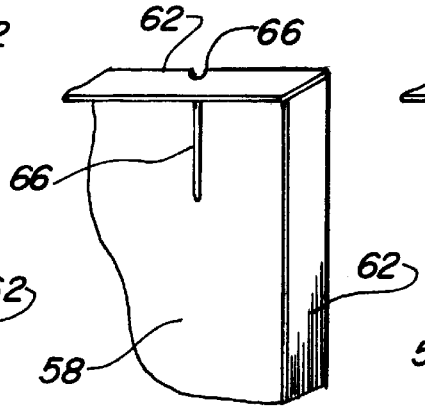
FIG. 10 is a partial isometric view of the front corner of the door inner panel having the keyhole-shaped slot with the flanges bent.
Figure 11:
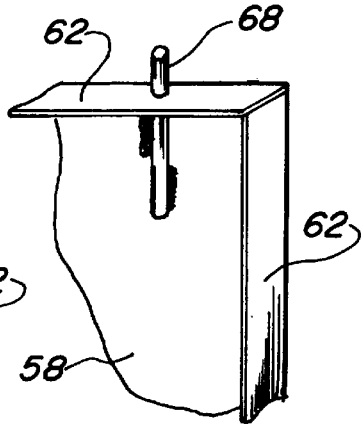
FIG. 11 is a partial isometric view of the front corner of the door inner panel with the pin positioned within the keyhole-shaped slot and welded in place.
Figure 12:
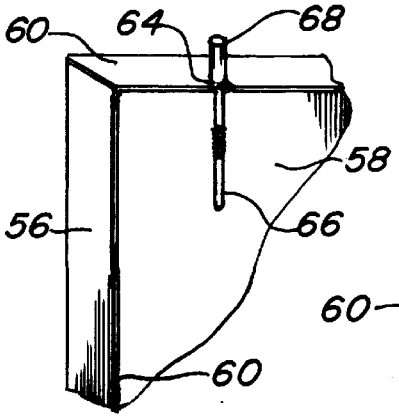
FIG. 12 is a partial isometric view of the back corner of the door inner panel with the pin positioned in the keyhole and welded on the back side.
Figure 13:
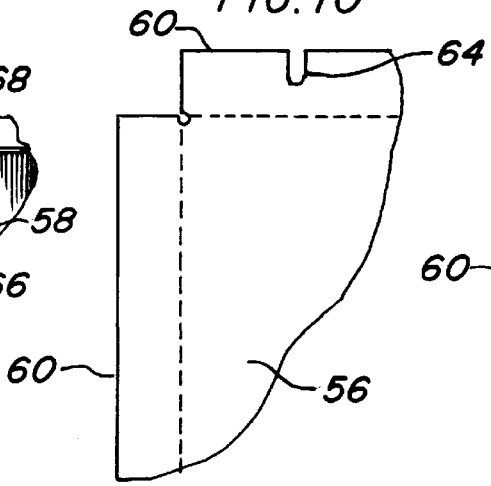
FIG. 13 is a front view of the corner of the door outer panel in the flat.
Figure 14:
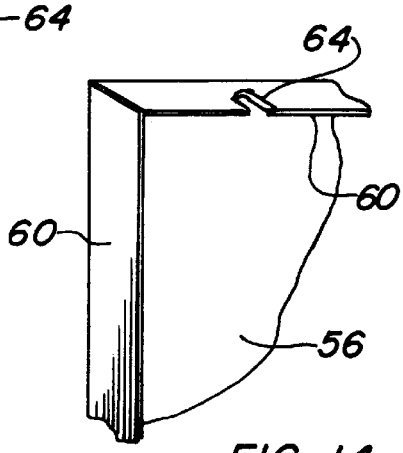
FIG. 14 is a partial isometric view of the back corner of the door outer panel, including the open ended slot with the flanges bent.
Figure 15:
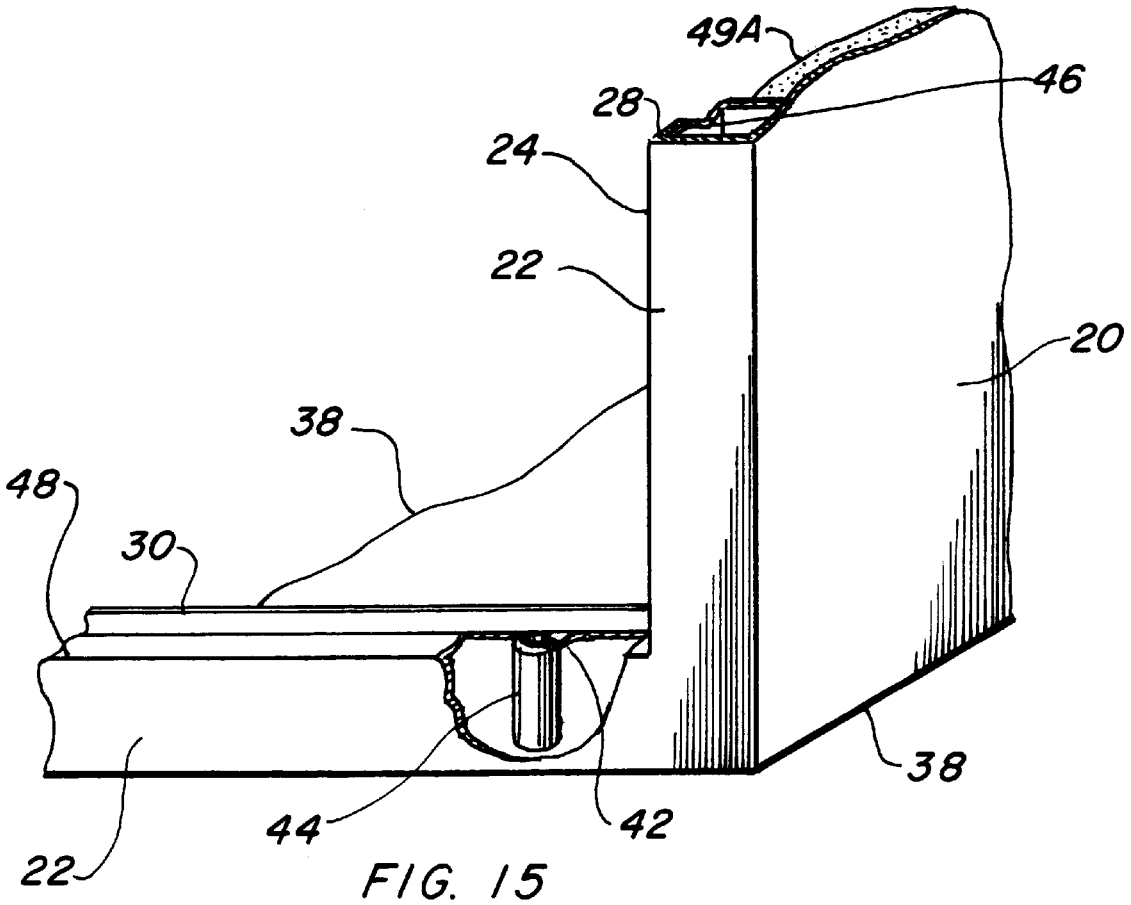
FIG. 15 is a partial isometric view of the hinge side of the safe cabinet partially cut-away to illustrate the location of the load bearing compression sleeve within the bottom of the safe.
Figure 16:
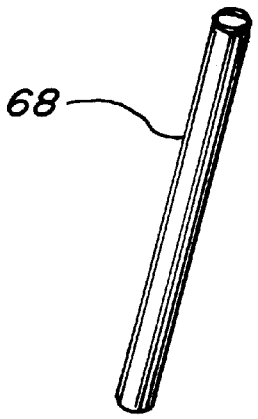
FIG. 16 is a partial isometric view of the pivot pin completely removed from the invention for clarity.

The outer panel 56 contains a pair of opposed open ended slots 64 located on the top and bottom of the hinge side 52, as depicted in FIGS. 13 and 14. The inner panel 58 has a pair of opposed keyhole shaped slots 66, also on the hinge side 52, that are in a similar location as the open ended slots 64 in its mating panel. These keyhole shaped slots 66 are illustrated in FIGS. 9 and 10, and it will be noted that the larger end of the slot is positioned directly on the bend line of the flange 62, such that when bent upwardly, as shown in FIG. 10, the slot becomes a round hole at the apex of the bend. A pivot pin 68 is inserted into each hole formed by the keyhole shaped slot 66, and is positioned touching the remainder of the slot. This positioning places a small portion of the pin longitudinally within the slot and locates the exact spot for the pin to permit a specific portion to protrude from the flange 62. The size and shape of the keyhole shaped slot 66 creates a positive locator for positioning the pin without the necessity of external jigs or fixtures. Each pin 68, illustrated by itself in FIG. 16, is cylindrical in shape and is preferably made of cobalt alloy steel bar stock, well known for its hardness and resistance to cutting. The slot 66 is substantially one-third the width of the diameter of the pin 68, embedding the pin into the parent metal of the panel 58 and then permanently retained with fastening means, preferably resistance welding. While the entire pin 68 may be welded through the slot on the panels interior surface and along each side of the pin to the panels interior surface, it has been found that skip welding is entirely sufficient, as any thrust loads and side loading is basically taken up by the hole formed by the slot 66 in the parent metal itself and the open ended slot 64, when the panels 56 and 58 are mated and welded together. The pin 68 obviously protrudes from the door 50 sufficiently for attachment purposes, but its length is of little importance and may vary with the application.

Figure 2:
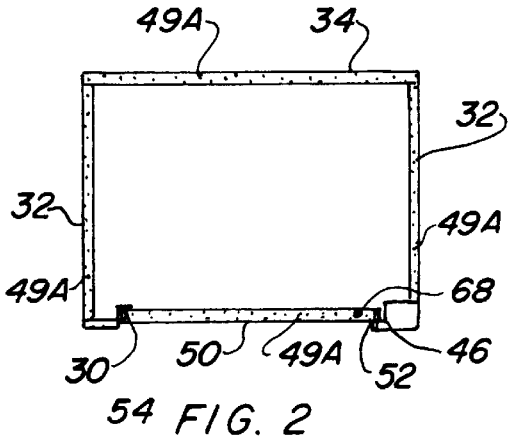
FIG. 2 is a cross-sectional view taken along lines 2—2 of FIG. 1.
Figure 3:
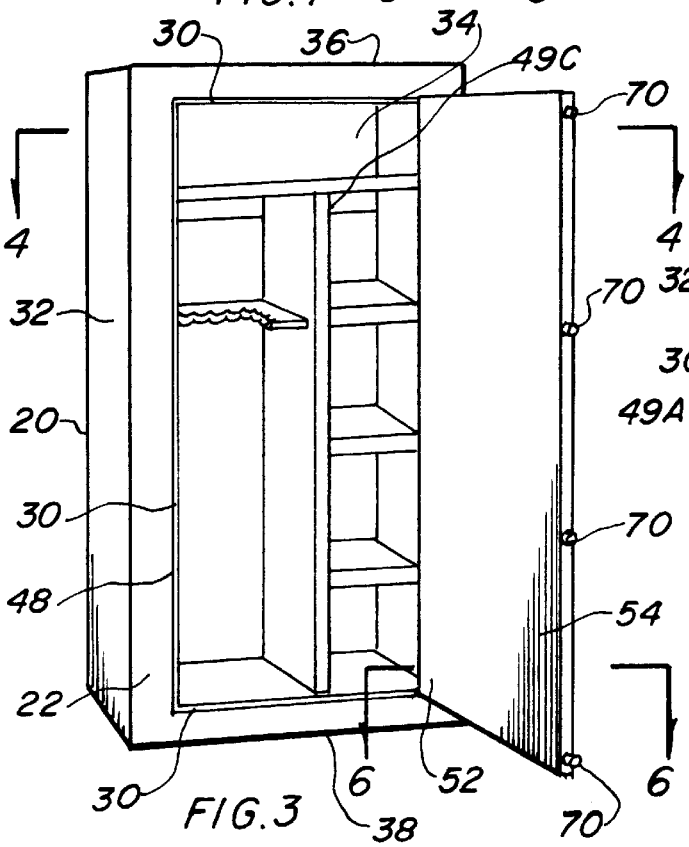
FIG. 3 is an isometric view of the preferred embodiment with the door open.
Figure 4:
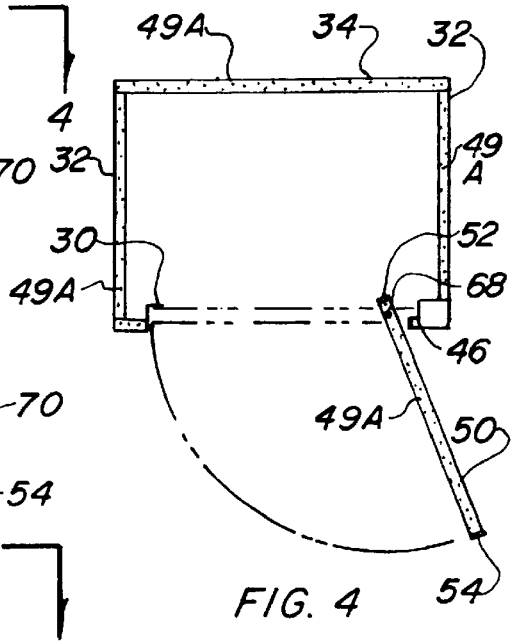
FIG. 4 is a cross-sectional view taken along lines 4—4 of FIG. 2.

As previously discussed, the cabinet 20 includes a door opening 48 formed by the doorjambs 30 and a pin receiving hole 40 in the top, and a sleeve retaining hole 42 in the bottom doorjamb 30. The door 50 is pivotally interposed into the cabinet 20 with the top pin 68 engaging the pin hole 40 and the bottom pin 68 engaging the sleeve hole 42 and sleeve 44 simultaneously, such that the door is pivotally retained within the cabinet and interfaces with the doorjambs 30. The hinge side 52 of the door 50 interfaces with the reversed discrete doorjamb 46 on the front surface of the door, while the locking side 54, along with the top and bottom, jointly interface on the rear surface of the door with the mating doorjambs 30. FIGS. 2 through 4 illustrate this relationship with its advantageous feature of positioning the hinge side 52 of the door 50 behind the structure of the cabinet 20. Further, with this arrangement, the bottom pin 68 is essentially inaccessible, as it is compressed by the weight of the door onto the sleeve 44 that transfers this load directly to the bottom 38 of the safe. The top pin 68 is visible, but since the gap between the door 50 and the cabinet 20 is narrow and the pin is positioned at the extreme rear of the door, access is almost nil.

Figure 17:
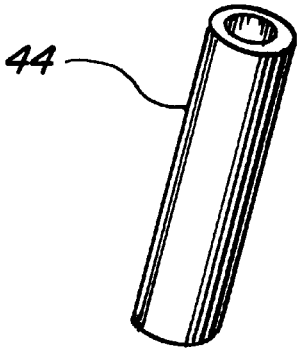
FIG. 17 is a partial isometric view of the compression sleeve completely removed from the invention for clarity.

It should also be noted that the compression sleeve 44, shown by itself in FIG. 17, is fabricated from a hollow metal tube with sufficient length to rest on the cabinet bottom 38 and extend adequately above the doorjamb 30, so as to permit a gap between the bottom of the doorjamb and the door 50 sufficient to allow the door to swing open and closed freely.

While the invention is directed to the pivotal hinge arrangement for the safe, obviously lock work 70 must be included, such as commonly used bolts, locks, handles, relockers, etc., to secure the door. This lock work 70 may be of any type or style, as they are all well known in the art and in common usage in the security safe industry.

While the invention has been described in complete detail and pictorially shown in the accompanying drawings, it is not be limited to such details, since many changes and modifications may be made in the invention without departing from the spirit and scope thereof. Hence, it is described to cover any and all modifications and forms which may come within the language and scope of the appended claims.

What is claimed is:

1. A pivotal hinge security safe comprising:

a cabinet having a front, including a hinge edge and a locking edge, the hinge edge containing an inwardly protruding flange and the front locking edge containing a doorjamb, further, a pair of sides, a back, a top including a formed doorjamb, and a bottom also including a formed doorjamb, said top doorjamb having a pin receiving hole adjacent to the cabinet front hinge edge, said bottom doorjamb having a sleeve retaining hole adjacent to the cabinet front hinge edge and a load bearing compression sleeve disposed within said retaining hole by permanent joining means, said cabinet front and one side, on the locking edge, include a reversed discrete doorjamb permanently attached to the inwardly protruding flange, with all four of said doorjambs in concert forming a door opening, a door, within the door opening, said door having a hinge side and a locking side with an outer panel having inwardly protruding flanges and an inner panel with outwardly protruding flanges with the inner panel juxtapositioned into the outer panel and the flanges contiguously embracing each other, said door outer panel having a pair of opposed open ended slots on the hinge side, said door inner panel having a pair of opposed keyhole shaped slots on the hinge side, and a pair of pivot pins disposed within the open ended slot and keyhole shaped slot in the door and retained with fastening means with the pins protruding from the panel flanges, and said door pivotally interposed into the cabinet with one pin engaging the pin receiving hole and one pin engaging the compression sleeve simultaneously, such that the door is pivotally retained within the cabinet and the hinge side of the door outer panel interfaces with the discrete doorjamb, while the door inner panel interfaces with the doorjambs of the top, bottom and front locking edge, making the pins essentially inaccessible from an outside surface of the safe and enclosing the door within the cabinet on the hinge edge.

2. The pivotal hinge security safe as recited in claim 1 wherein said cabinet front, sides and back are formed from a single segment of flat metal sheetstock.

3. The pivotal hinge security safe as recited in claim 1 wherein said cabinet top and bottom are permanently joined to the front, back and sides by welding.

4. The pivotal hinge security safe as recited in claim 1 wherein said cabinet and door are characterized by an absence of through-holes and mounting hardware for attachment of any component parts, such that the safe forms a secure barrier preventing entry and the hinge pins are essentially inaccessible.

5. The pivotal hinge security safe as recited in claim 1 wherein said weight bearing compression sleeve further comprises a hollow metal tube having a length sufficient to rest on the cabinet bottom and to extend adequately above the formed bottom doorjamb, so as to permit the door to swing open and closed freely.

6. The pivotal hinge security safe as recited in claim 1 wherein said compression sleeve joining means is resistance welding.

7. The pivotal hinge security safe as recited in claim 1 wherein said door is formed from two separate segments of flat metal sheetstock.

8. The pivotal hinge security safe as recited in claim 1 wherein said pivot pins are cobalt alloy steel bar stock.

9. The pivotal hinge security safe as recited in claim 1 wherein said pivot pin fastening means is resistance welding.

10. A pivotal hinge security safe comprising:

a cabinet having a door opening in a front defined by a top doorjamb, a bottom doorjamb, a locking edge side doorjamb and a front hinge edge side with a discrete reversed doorjamb, a door, within the door opening, said door including an outer panel and a inner panel, with said outer panel having a pair of opposed open ended slots on a hinge side, and said inner panel having a pair of opposed keyhole shaped slots on a hinge side, a pair of protruding pivot pins, permanently retained within the open ended slot and keyhole shaped slot in the door, and said door pivotally interposed into the cabinet with said pins engaging the doorjambs such that the door is pivotally retained within the cabinet and the hinge side of the door outer panel interfaces with the discrete doorjamb, while the door inner panel interfaces with the remaining doorjambs, causing the pins to be essentially inaccessible from outside of the safe.

11. The pivotal hinge security safe as recited in claim 10 wherein said cabinet and door are characterized by an absence of through-holes and mounting hardware for attachment of any component parts such that the safe forms a secure barrier preventing entry and the hinge pins are essentially inaccessible.

* * * * *